United States Patent [19]

Gaynor

[11] 4,157,712

[45] Jun. 12, 1979

[54] HUMAN BODY STIMULATION DEVICE

[76] Inventor: Jon E. Gaynor, 447 Commercial St., Provincetown, Mass. 02657

[21] Appl. No.: 844,271

[22] Filed: Oct. 21, 1977

[51] Int. Cl.[2] ..... A61H 15/00

[52] U.S. Cl. ..... 128/57

[58] Field of Search ..... 128/57, 24.3, 67, 60, 128/24.4

[56] References Cited

U.S. PATENT DOCUMENTS 1,671,019 5/1928 Falck ..... 128/57

3,850,163 11/1974 Andis ..... 128/57

3,970,078 7/1976 Rogers ..... 128/57

FOREIGN PATENT DOCUMENTS 177513 7/1953 Austria ..... 128/57

*Primary Examiner*—Lawrence W. Trapp

[57] ABSTRACT

A human body stimulation device comprising a body portion having polygonal wheels rotatably mounted on each side of the body portion. The corners of the pairs of opposed wheels may be arced and may be in aligned or staggered relation to each other.

6 Claims, 3 Drawing Figures

HUMAN BODY STIMULATION DEVICE

BACKGROUND OF THE INVENTION

This invention relates generally to a human body stimulation device having polygonal configured wheels rotatably attached to a body portion.

Many different methods have been employed to provide human body stimulation resulting in pleasurable sensation. One of the oldest methods, known in the time of the ancient Greeks and Romans, is the use of a hand massage. When given by a trained masseur, the massage will provide therapeutic effects such as increased circulation and release of muscle tension. In fact, claims are made for some types of massage that they are capable of diagnosing and alleviating human muscular and nerve problems. Due to the fact that giving a proper massage requires training, devices have been utilized to achieve some of the results of massage without requiring extensive operator training. The most popular of these devices at present employ means which are vibrated against the subject. In one type of device, the vibrator is attached to the back of a human operator's hand imparts vibratory motion to the fingers, which in turn is transmitted to the subject.

There are a number of prior art devices having rotatable massage units which are positioned within flanges such as the U.S. Patent to Carlson, U.S. Pat. No. 1,776,806 issued Sept. 30, 1930, which is motor rotated, and the U.S. Patent to Cash, U.S. Pat. No. 2,593,982 issued Apr. 22, 1952, which utilizes a series of rotatable rollers positioned between plates and longitudinally spaced from each other to massage the sole of a human foot. The rollers have annular protrusions which are aligned longitudinally and whose surfaces are non-aligned longitudinally. Another form of roller is disclosed in the U.S. Patent to Thurman, U.S. Pat. No. 3,662,748 issued May 16, 1972, which includes faceted side flanges that provide a vibrating action to the roller when it is rolled on the floor. A device similar to the Cash device is disclosed in the U.S. Patent to Morrison U.S. Pat. No. 3,645,256 issued Feb. 29, 1972. A hand massaging device is shown in the U.S. Patent to Kelly, U.S. Pat. No. 2,572,627 issued Oct. 23, 1951. The Kelly device has a series of rollers mounted in spaced, rotatable, longitudinal relation between two longitudinally extending sides.

None of the cited prior art disclose a "massage" device having the wheels positioned along side (in juxtaposition) and external to the sides of the body portion, nor do they disclose a pair of polygonal wheels in spaced, opposed relation to each other with the corners of one staggered or aligned in relation to the corners of the other.

SUMMARY OF THE INVENTION

This invention relates to a human stimulation device having a body portion and at least one set of rotatable polygonal wheels associated with the body portion. A wheel of a pair is positioned on each side of the body portion and adapted to be rolled over a human subject by movement of the body portion. The wheels may be in fixed, spaced relation to each other. The corners of one of the wheels may be either aligned or in staggered relation to the corners of the other wheel and the corners in their contact position extend below the base of the body portion.

To increase comfort when applied to the subject, the wheels are provided with externally arced or curved corners. The external configuration of the upper part of the body portion is formed to fit comfortably within the operator's hand and may include an upwardly bowed portion which is adapted to lie within the operator's cupped palm. The upper part of the body portion may also include a transverse depression or ridge against which the heel of the operator's palm rests.

In the illustrated embodiment, two pairs or sets of polygonal wheels are employed and they are positioned in a manner similar to motor vehicle wheels. In this case each set of wheels may have the corners of one wheel aligned or staggered in relation to the corners of the other wheel. Of course, a portion of each wheel extends below the base of the body portion.

BRIEF DESCRIPTION OF THE DRAWINGS

Other features and advantages of the invention will be apparent from the specification and claims when considered in connection with the accompanying drawings in which:

DESCRIPTION OF THE PREFERRED EMBODIMENT

Figure 1:
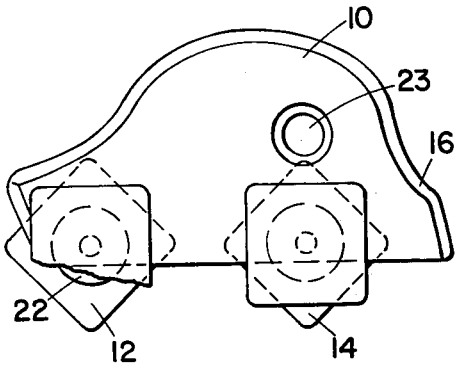
FIG. 1 is a side elevation of the stimulation device according to the invention.
Figure 2:
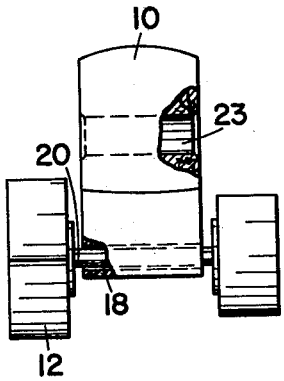
FIG. 2 is a front elevation of the device shown in FIG. 1.
Figure 3:
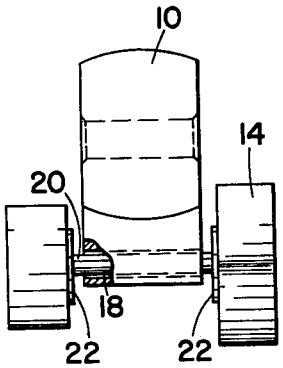
FIG. 3 is a rear elevation of the device shown in FIG. 1.

There is shown in the drawing a human body stimulation device comprising a solid body portion 10 having a thickness of approximately 1 ¾", which may be comfortably grasped by the human hand and first and second pairs of wheels 12, 14. The body portion 10 includes an upper or top surface having a side extending downwardly at right angles from each of the edges of the top surface. The lower edges of the sides are connected by a flat base. The top surface or part of the body portion may be bowed upwardly to accept the palm of the human hand and may include a transverse depression or ridge 16 into which or against which a portion of the heel of the operator's hand will fit. The upward extending bow, arc or bulge of the body portion provides comfortable gripping of the device, but it is by no means critical and other configurations such as a transversely arced top part without the bulge may be utilized. Two transverse, spaced tubular passageways 18 are formed through the sides approximately ½ inch up from the flat base of the body portion 10. The first passageway 18 is formed about 1 inch from the front of the body portion 10 and the second passageway 18 is formed about 1½ inches forward of the rear of the body portion 10.

Each of the wheels 12, 14 is substantially polygonal, more specifically square in the embodiment shown in the drawings, in external configuration having the corners arced for comfort of the subject, although any configuration resulting in removal of the sharp edges of the corners will probably be sufficient. An axle 20 is positioned in each passageway 18 with its free terminal ends extending beyond the sides of the body portion 10. Each of the terminal ends of the axle 20 is passed through a central aperture formed in a circular washer or spacer 22 and is then press fitted into a transverse channel centrally located in the wheels 12, 14. The washers 22 space the wheels 12, 14 from the body portion 10 preventing binding of the wheels 12, 14 against the body portion 10, when the wheels are rotating. In the staggered wheel orientation, each corner of one of the pair of wheels 12, 14 is positioned to point at the midpoint of an extended plane of the flat portion between the corners of its opposing wheel. In other words, the corners of one wheel of a pair is 45° out of alignment with the other wheel of the pair. The orientation of the wheels on the same side of the body portion is similar as shown in FIG. 1.

The wheel positioned externally of one side of the body portion is in fixed parallel relation with its mating wheel attached to the other end of its axle and positioned externally of the other side of the body portion. The corners of one wheel are in staggered relation to the corners of its mating wheel and the corners of both wheels extend below the base when the corners are rotated to lowest position as indicated in FIG. 1. The fit of the axle 20 within the passageway 18 is such that the axle 20 and its attached wheels 12, 14 can be rotated when the wheels are moved against and over a surface.

The device may be utilized with only a single pair of wheels placed in the same position as the wheels 12, if desired.

The inventor has discovered that the stimulation device when rolled over a nude or lightly clothed human subject will induce a pleasurable or titillating sensation in the subject. Friction between the subject and the device can be reduced by using mineral or organic oils on the area of a nude subject being worked upon, although this use of oil is not absolutely necessary. The action of the rolling, staggered polygonal wheels imparts a "massage" effect which heightens the induced pleasurable sensation. This "massage" effect is also present to a lesser degree if the pair of spaced, parallel wheels have their corners in opposed, aligned relationship. If the corners of the paired wheels are in a staggered relationship, the corners of the wheels on one side of the body portion will contact the subject as the flat edge of the wheels on the other side contact the subject and vice versa. This relationship imparts a rocking motion to the device as it is moved over the subject.

The device is employed by a human operator who grips the upper part of the body portion 10 with the palm over the upper surface and rolls the wheels 12, 14 over the body of a human subject. By varying the applied pressure, the depth of stimulation may be varied.

The inventor has utilized a hard wood such as maple or walnut as a construction material, however, a light metal, such as aluminum or a plastic material may be used.

A transverse through aperture 23 is formed in the upper part of the body portion 10 to provide a means for engaging a string for hanging the device when it is not in use.

What I claim is:

1. A human body stimulation device comprising a body portion and a first pair of wheels associated with the body portion, the body portion having two sides in spaced relation to each other, each of the two sides having an upper edge connected by an upper surface and a lower edge connected by a base, the first pair of wheels include a first wheel and a second wheel which are rotatable in relation to the body portion and the first wheel being in spaced relation to the second wheel, the first wheel being in juxtaposition with one of the sides of the body portion and the second wheel being in juxtaposition with the other side of the body portion, the first and second wheels each having an external configuraton including corners and having at least one flat edge for engaging the human body and each wheel having a portion adapted to extend to a plane below the base.

2. A device as recited in claim 1 wherein the corners of the first wheel are in fixed, staggered relation to the corners of the second wheel.

3. A device as recited in claim 1 wherein the body portion includes a transverse passageway and each of the corners has an arced, external configuration and the first wheel is connected to the second wheel by an axle and a portion of the axle is positioned within the passageway.

4. A stimulation device as recited in claim 1 further comprising a second pair of wheels rotatably associated with the body porton and including a third wheel and a fourth wheel, the second pair of wheels longitudinally spaced from the first pair of wheels and the third wheel being in spaced relation to the fourth wheel, the third wheel in juxtaposition with one of the sides of the body portion and the fourth wheel being in juxtaposition with the other side of the body portion, the third and fourth wheels each having a polygonal external configuration including corners and the third and fourth wheels each having a portion adapted to extend to a plane below the base.

5. A stimulation device as recited in claim 4 wherein the external configuration of the corners of the third and fourth wheels are arced and the corners of the third wheel are in staggered relation to the corners of the fourth wheel.

6. A stimulation device as recited in claim 1 further comprising a second pair of wheels including a third wheel and a fourth wheel, the second pair of wheels associated with the body portion and spaced from the first pair of wheels, the third wheel positioned on one side of the body portion and the fourth wheel positioned on the other side of the body portion in parallel relation to the third wheel, each of the wheels having an external configuration including corners, and having at least one flat edge for engaging the human body.

* * * * *